United States Patent [19]

Burnham et al.

[11] 3,991,450

[45] Nov. 16, 1976

[54] METHOD OF SEPARATING APERTURED SHADOW MASK FLATS AFTER ANNEALING

[75] Inventors: James A. Burnham, Lowman; James O. Frey, Horseheads, both of N.Y.

[73] Assignee: Westinghouse Electric Corporation, Pittsburgh, Pa.

[22] Filed: June 10, 1975

[21] Appl. No.: 585,912

[52] U.S. Cl. ..... 29/17 A

[51] Int. Cl.[2] ..... B21D 33/00

[58] Field of Search ..... 29/17 R, 17 A, 239

[56] References Cited

UNITED STATES PATENTS

| | | | |
|---|---|---|---|
| 558,457 | 4/1896 | McCarty | 29/17 A |
| 712,617 | 11/1902 | Swindell | 29/17 A |
| 2,364,780 | 12/1944 | De Walt | 29/17 A |

*Primary Examiner*—Gil Weidenfeld

*Attorney, Agent, or Firm*—W. G. Sutcliff

[57] ABSTRACT

A method of separating apertured shadow mask flats after annealing in which a stack of thin flats is passed through a roller leveler, with the rollers set apart by a dimension slightly less than the thickness of the stack.

1 Claim, 3 Drawing Figures

METHOD OF SEPARATING APERTURED SHADOW MASK FLATS AFTER ANNEALING

BACKGROUND OF THE INVENTION

The present invention relates to a process in the fabrication of apertured shadow masks which are used in color television picture tubes. An apertured shadow mask is the thin metal member, having a plurality of apertures therethrough, for aligning the electron beam with the phosphor on the picture tube screen. The apertures are provided in the thin sheet of metal by a photodelineation and etching process, and the apertured metal portion is termed a flat. The metal flat must then be annealed and work hardened to give sufficient structural strength to be formed into the shadow mask usable in a picture tube. The annealing process is carried out in a reducing atmosphere, typically at about 1800° F for about 45 minutes, as is well known in the art. The typical shadow mask flat is about 6 mils in thickness and has an area which depends upon the size of the picture tube to be produced, but is typically a rectangular body several feet by several feet. The annealing process is typically carried out using an annealing conveyor upon which the shadow mask flats are disposed in passing slowly through the high temperature furnace reducing atmosphere. Because of the tremendous number of pieces which must be processed and the relative thinness of the shadow mask flats, it is desirable to stack the shadow mask flats and to pass the stacked unit through the annealing furnace. It is very difficult to separate the individual shadow mask flats from the annealed stack of flats. It has been the practice to effect such separation manually and by just physically forcing or prying the members apart at their edges. The stack of shadow mask flats comes out of the annealing furnace as a relatively rigid unit which is very difficult to separate and which must be separated without damage or deformation of the individual thin flats.

It is the practice in the annealing stage to place the stacked shadow mask flats between an upper and lower carrier plate which carries the stack of flats on the annealing conveyor through the furnace. Obviously, the higher number of individual flats which can be stacked for passage through the annealing furnace, the greater the manufacturing efficiency. A particular problem has been encountered in separating stacked apertured shadow mask flats of the slot mask type. A slot aperture shadow mask is one in which the apertures are generally rectangular rather than the conventional circular aperture mask. The slotted masks tend to be much more difficult to separate upon completion of the annealing of a stack of slotted aperture flats.

It has been the practice in the handling of sheet metal stacks to separate stuck together sheets by first bending the sheets and then rolling the bent sheets flat, as seen in U.S. Pat. No. 558,457. U.S. Pat. No. 712,617 teaches the separation of metal sheets from a stack in which the sheets are stuck together, by bending the stack alternately about upper and lower rollers. The rollers of this early teaching are alternate with the lowermost extending perimeter portion of the upper rollers projecting below the uppermost extending perimeter of the lower rollers. The stack of sheets must be bent about each succeeding roller as the stack advances. The teaching is directed specifically to tin sheet which is typically relatively thick and flexible.

The shadow mask flats are very thin sheets of metal, typically six mils thick. The apertured flat is particularly susceptible to permanent deformation because of these apertures.

SUMMARY OF THE INVENTION

A method of separating a stack of apertured, very thin, shadow mask flats by passing the stack between spaced upon upper and lower rollers. The rollers are spaced apart such that the dimension between the parallel tangents to the upper and lower rollers is slightly less than the thickness of the stack of flats.

DESCRIPTION OF THE PREFERRED EMBODIMENT

Figure 1:
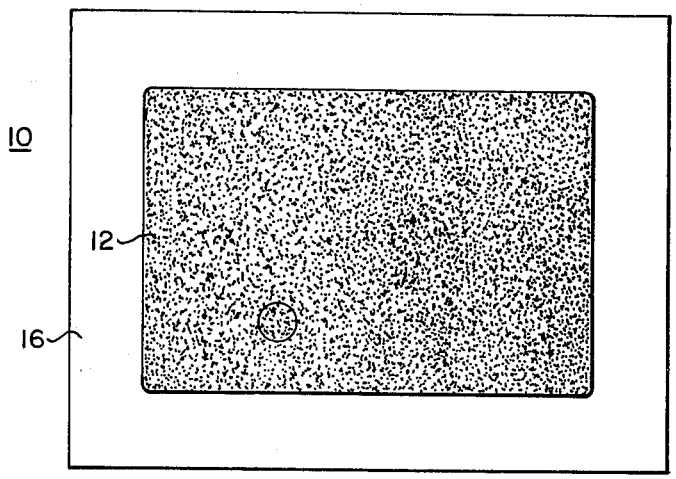
FIG. 1 gives an illustration of an apertured shadow mask flat.
Figure 2:
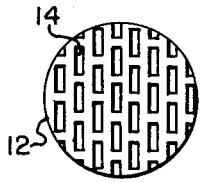
FIG. 2 is an enlarged view of the apertured portion of the shadow mask flat.

The shadow mask flat 10 is illustrated in FIG. 1 and comprises a thin metal member typically about 6 mils in thickness. The shadow mask flat 10 comprises a centralized aperture portion 12 which is here shown having a plurality of rectangular slot apertures 14, and a solid skirt portion 16 surrounding the apertured portion. The shadow mask flat after processing and before incorporation into the color television picture tube will be spherically curved so that the central aperture portion 12 serves as the standard shadow mask, and the solid skirt portion 16 is formed into a support, which can be held in place relative to the glass picture tube funnel as is well known.

Figure 3:
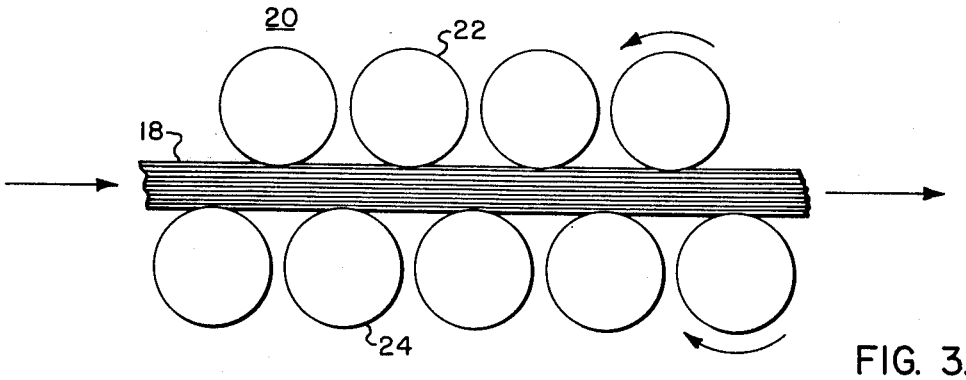
FIG. 3 is a schematic representation of the procedure for separating the stack of shadow mask flats.

A plurality of such apertured shadow mask flats 10 are typically stacked one on top of the other in a stack which may be two to 30 individual units high, and is placed between an upper and a lower steel carrier plate which are relatively thicker. These stacked flats pass through the annealing furnace in about 45 minutes, and are heated to a temperature about 1800° F in a reducing atmosphere to soften the metal. The stack of shadow mask flats is seen in FIG. 3, and the carrier plates are removed, and the stack 18 is passed through a roller leveler 20 which comprises a plurality of upper rollers 22 and lower rollers 24 which are spaced apart a dimension which is slightly less than the thickness of the stack of shadow mask flats. By way of example, the roller leveler comprises eight upper rollers which are spaced apart by approximately ⅛ inch and have a diameter of approximately ¾ inch with the nine lower rollers being spaced a similar ⅛ inch apart and also being of about ¾ inch diameter. The spacing between the upper and the lower rollers is preferably maintained at about 15 mils or 0.015 inch less than the total thickness of the stack of shadow mask flats. Thus, for a stack of 10 shadow mask flats which are 6 mils thick each, the total stack thickness is 60 mils, and the distance between the upper and lower rollers is set at 45 mils.

As shown in FIG. 3 the upper rollers 22 are rotated in a counterclockwise direction and the bottom rollers 24 are rotated in a clockwise direction. The stack of shadow mask flats 18 is fed between the rollers and is passed through the roller leveler at a speed such that the entire stack passes through in about 1 second. The fact that the roller spacings are set less than the thickness of the stack of flats causes a flexure of the stack passing through the roller leveler which results in loosening of the stuck together flats permitting easy separation by just a simple physical lifting off of individual flats.

The separation of the stacked shadow mask flats by passage through the roller leveler is effected without physical bending or damage to the individual flats, and the ability to stack them results in a significant time and energy saving in processing the flats.

We claim:

1. Method of separating an annealed stack of thin, planar, shadow mask flats, each flat being approximately 0.006 inch thick and having a plurality of apertures provided through the body thereof, comprising the steps of arranging two series of rollers one above the other and alternating the rollers of one series with the rollers of the other series so that each roller in said one series is disposed between two rollers in said other series, spacing apart the two series of rollers by a distance which is approximately 0.015 inch less than the stack distance, and feeding said stack of flats between said series of rollers while they are being rotated, whereby a flexure of the stack of flats occurs which permits easy separation of the individual flats after they have passed through the rollers.

* * * * *